US010392969B2

(12) United States Patent
Kapustka et al.

(10) Patent No.: US 10,392,969 B2
(45) Date of Patent: Aug. 27, 2019

(54) MOMENT ACCOMMODATING FASTENER ASSEMBLY

(71) Applicant: United Technologies Corporation, Hartford, CT (US)

(72) Inventors: Theodore W. Kapustka, Glastonbury, CT (US); Joseph J. Sedor, Oxford, MA (US)

(73) Assignee: United Technologies Corporation, Farmington, CT (US)

( * ) Notice: Subject to any disclaimer, the term of this patent is extended or adjusted under 35 U.S.C. 154(b) by 318 days.

(21) Appl. No.: 14/937,436

(22) Filed: Nov. 10, 2015

(65) Prior Publication Data

US 2016/0153315 A1 Jun. 2, 2016

Related U.S. Application Data

(60) Provisional application No. 62/086,528, filed on Dec. 2, 2014.

(51) Int. Cl.

| | |
|---|---|
| ***F01D 9/06*** | (2006.01) |
| ***F01D 25/16*** | (2006.01) |
| ***F01D 25/26*** | (2006.01) |
| ***F01D 25/28*** | (2006.01) |

(52) U.S. Cl.

CPC ..... *F01D 25/162* (2013.01); *F01D 25/26* (2013.01); *F01D 25/28* (2013.01); *F01D 9/065* (2013.01); *F05D 2250/281* (2013.01)

(58) Field of Classification Search

CPC ..... F01D 25/162; F01D 25/26; F01D 25/28; F01D 9/065; F05D 2250/281; F02C 7/20

USPC ..... 415/108, 110, 113, 142, 201, 214.1; 416/244 R; 411/140, 388; 403/335, 337

See application file for complete search history.

(56) References Cited

U.S. PATENT DOCUMENTS

| | | | | |
|---|---|---|---|---|
| 3,369,366 | A * | 2/1968 | Howald | F02C 7/20 60/39.83 |
| 6,102,577 | A * | 8/2000 | Tremaine | F01D 9/065 184/104.1 |
| 8,747,054 | B2 | 6/2014 | Witlicki | |
| 8,794,009 | B2 | 8/2014 | Glahn et al. | |
| 8,863,531 | B2 | 10/2014 | Scott et al. | |
| 2007/0227299 | A1 * | 10/2007 | Marchiando | B22F 3/115 75/244 |
| 2010/0303610 | A1 | 12/2010 | Wang et al. | |
| 2013/0115079 | A1 | 5/2013 | Farah et al. | |
| 2014/0013770 | A1 | 1/2014 | Farah et al. | |
| 2014/0013771 | A1 | 1/2014 | Farah et al. | |
| 2014/0102110 | A1 | 4/2014 | Farah et al. | |
| 2014/0227078 | A1 | 8/2014 | Chokshi | |

* cited by examiner

*Primary Examiner* — Ninh H. Nguyen
*Assistant Examiner* — Brian P Wolcott
(74) *Attorney, Agent, or Firm* — O'Shea Getz P.C.

(57) ABSTRACT

An assembly is provided for a turbine engine. This turbine engine assembly includes a tie-rod and a threaded retainer. The tie-rod includes a tie-rod threaded portion and a tie-rod unthreaded portion. The threaded retainer includes a retainer threaded portion and a retainer unthreaded portion. The retainer threaded portion is mated with the tie-rod threaded portion. The retainer unthreaded portion is radially engaged with the tie-rod unthreaded portion.

14 Claims, 6 Drawing Sheets

MOMENT ACCOMMODATING FASTENER ASSEMBLY

This application claims priority to U.S. Patent Appln. No. 62/086,528 filed Dec. 2, 2014.

BACKGROUND OF THE INVENTION

1. Technical Field

This disclosure relates generally to a fastener assembly such as, for example, a tie-rod assembly.

2. Background Information

Various fastener assemblies, such as tie-rod assemblies, are known in the art for structurally connecting a plurality of components together. In general, these known fastener assemblies are designed to transfer axial loads between the components; i.e., transfer loads along an axis of the fastener or tie-rod. Such fastener assemblies therefore may be incapable of accommodating moment loads or otherwise transferring radial loads between the components. Furthermore, when moment loads are applied to such known fastener assemblies, these assemblies may be subjected to relatively high internal stresses that can cause premature failure.

There is a need in the art for an improved fastener assembly which can accommodate moment loads.

SUMMARY OF THE DISCLOSURE

According to an aspect of the invention, an assembly is provided for a turbine engine. This turbine engine assembly includes a tie-rod and a threaded retainer. The tie-rod includes a tie-rod threaded portion and a tie-rod unthreaded portion. The threaded retainer includes a retainer threaded portion and a retainer unthreaded portion. The retainer threaded portion is mated with the tie-rod threaded portion. The retainer unthreaded portion is radially engaged with the tie-rod unthreaded portion.

According to another aspect of the invention, a fastener assembly is provided for a turbine engine. This fastener assembly includes a fastener and a threaded retainer with a bore that receives the fastener. A first portion of the threaded retainer is threaded with the fastener. A second portion of the threaded retainer is configured to radially engage the fastener.

According to another aspect of the invention, a tie-rod assembly is provided that includes a tie-rod and a threaded retainer with a bore that receives the tie-rod. First and second portions of the threaded retainer are each configured to engage the tie-rod. A third portion of the threaded retainer is disengaged from the tie-rod and axially between the first portion and the second portion.

The fastener may be configured as or otherwise include a tie-rod. The second portion may be configured as or otherwise include a retainer unthreaded portion.

The second portion may be configured as or otherwise include an unthreaded portion radially engaged with the tie-rod.

The first portion may be configured as or otherwise include a thread portion threaded with the tie-rod.

The tie-rod and the threaded retainer may be configured to transfer substantially all axial loads therebetween through the first portion. The tie-rod and the threaded retainer may also or alternatively be configured to transfer radial loads therebetween through the first and the second portions.

The tie-rod unthreaded portion and the retainer unthreaded portion may each be configured as or otherwise include a cylindrical surface.

The tie-rod may extend axially to an end. The tie-rod threaded portion may be axially between the end and the tie-rod unthreaded portion.

The tie-rod threaded portion may be located at the end.

The tie-rod may extend axially through the retainer unthreaded portion and into the retainer threaded portion.

The tie-rod threaded portion and the tie-rod unthreaded portion may be axially separated by another portion of the tie-rod that is radially disengaged from the threaded retainer.

The tie-rod unthreaded portion may be configured as or otherwise include a radial outward projection.

The retainer unthreaded portion may be configured as or otherwise include a radial inward projection.

The retainer threaded portion and the retainer unthreaded portion may be axially separated by another portion of the threaded retainer that is disengaged from the tie-rod.

The threaded retainer may include a tubular base and an annular flange. The annular flange may extend radially out from the tubular base.

The retainer threaded portion may be located axially between the annular flange and the retainer unthreaded portion.

A turbine engine case may be included. The threaded retainer may attach the tie-rod to the turbine engine case. The turbine engine case may be configured as or otherwise include a turbine intermediate case.

The retainer unthreaded portion and/or the tie-rod unthreaded portion may be coated with lubricant.

The foregoing features and the operation of the invention will become more apparent in light of the following description and the accompanying drawings.

DETAILED DESCRIPTION OF THE INVENTION

Figure 1:
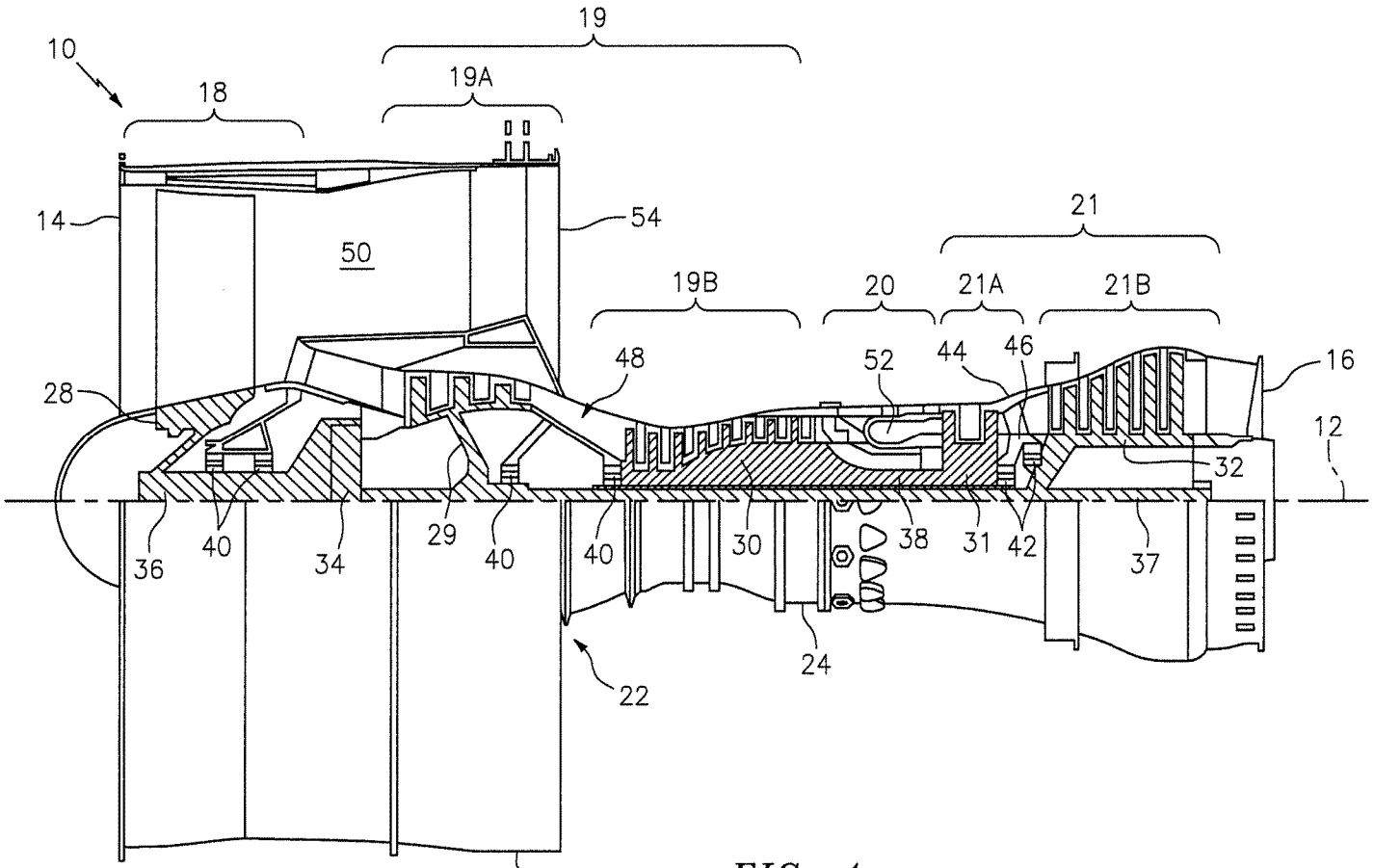
FIG. 1 is a side cutaway illustration of a geared turbine engine.

FIG. 1 is a side cutaway illustration of a geared turbine engine 10. This turbine engine 10 extends along an axial centerline 12 between an upstream airflow inlet 14 and a downstream airflow exhaust 16. The turbine engine 10 includes a fan section 18, a compressor section 19, a combustor section 20 and a turbine section 21. The compressor section 19 includes a low pressure compressor (LPC) section 19A and a high pressure compressor (HPC) section 19B. The turbine section 21 includes a high pressure turbine (HPT) section 21A and a low pressure turbine (LPT) section 21B.

The engine sections 18-21 are arranged sequentially along the centerline 12 within an engine housing 22. This housing 22 includes an inner case 24 (e.g., a core case) and an outer case 26 (e.g., a fan case). The inner case 24 may house one or more of the engine sections 19-21; e.g., an engine core. The outer case 26 may house at least the fan section 18.

Each of the engine sections 18, 19A, 19B, 21A and 21B includes a respective rotor 28-32. Each of these rotors 28-32 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 28 is connected to a gear train 34, for example, through a fan shaft 36. The gear train 34 and the LPC rotor 29 are connected to and driven by the LPT rotor 32 through a low speed shaft 37. The HPC rotor 30 is connected to and driven by the HPT rotor 31 through a high speed shaft 38.

The shafts 36-38 are rotatably supported by a plurality of bearings 40 and 42; e.g., rolling element and/or thrust bearings. Each of these bearings 40, 42 is connected to the engine housing 22 by at least one stationary structure such as, for example, a support strut and/or frame. One or more of the bearings 42, for example, are connected to a turbine intermediate case 44 (e.g., a mid-turbine case), which is a section of the inner case 24, through a turbine intermediate frame 46 as described below in further detail; see also FIG. 2.

During operation, air enters the turbine engine 10 through the airflow inlet 14, and is directed through the fan section 18 and into a core gas path 48 and a bypass gas path 50. The air within the core gas path 48 may be referred to as "core air". The air within the bypass gas path 50 may be referred to as "bypass air". The core air is directed through the engine sections 19-21, and exits the turbine engine 10 through the airflow exhaust 16 to provide forward engine thrust. Within the combustor section 20, fuel is injected into a combustion chamber 52 and mixed with the core air. This fuel-core air mixture is ignited to power the turbine engine 10. The bypass air is directed through the bypass gas path 50 and out of the turbine engine 10 through a bypass nozzle 54 to provide additional forward engine thrust. Alternatively, at least some of the bypass air may be directed out of the turbine engine 10 through a thrust reverser to provide reverse engine thrust.

Figure 2:
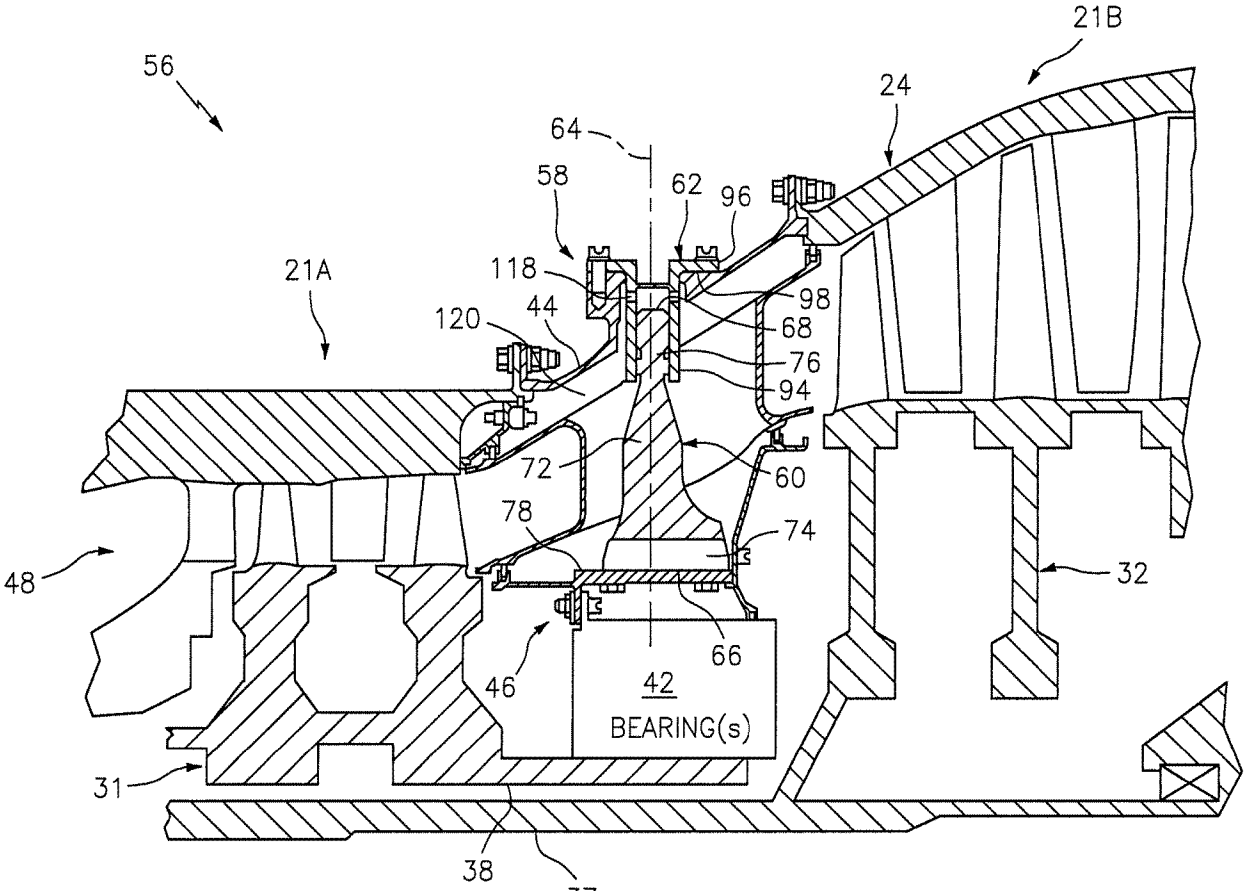
FIG. 2 is a side sectional illustration of an assembly for the turbine engine.

FIG. 2 illustrates an assembly 56 for the turbine engine 10. This turbine engine assembly 56 includes the inner case 24, at least one of the bearings 42 and the turbine intermediate frame 46, which includes a plurality of tie-rod assemblies 58 (one shown). These tie-rod assemblies 58 are arranged about the centerline 12. The tie-rod assemblies 58 are configured to structurally connect the bearing(s) 42 to the inner case 24; e.g., the turbine intermediate case 44. Each of the tie-rod assemblies 58 includes a tie-rod 60 and a threaded retainer 62 (e.g., a nut).

The tie rod 60 extends along a tie-rod axis 64 from an inner end 66 to an outer end 68. The tie rod 60 may be a hollow tie-rod. The tie rod 60 of FIG. 3, for example, includes an inner bore 70 which extends axially through (or partially into) the tie rod 60 from the outer end 68. This inner bore 70 may be provided to reduce the mass and weight of the tie rod 60. The inner bore 70 may also or alternatively be provided to form a flowpath for fluid such as cooling air, lubricant, etc. through the tie rod 60 and into an inner region of the engine core. Alternatively, the tie rod 60 may be a substantially solid tie-rod; i.e., configured without an axially extending inner bore.

Referring to FIG. 2, the tie rod 60 includes a shaft 72 that extends along the tie-rod axis 64 between an inner mount 74 and an outer mount 76. The inner mount 74 extends along the tie-rod axis 64 from the shaft 72 to the inner end 66. The inner mount 74 is configured to structurally attach the shaft 72 and, thus, the tie rod 60 to another component 78 of the turbine intermediate frame 46 such as a bearing housing or support. While the inner mount 74 is shown as being attached to the component 78 by a plurality of fasteners (e.g., bolts), the tie rod 60 is not limited to including such an inner mount configuration. The inner mount 74, for example, may alternatively include a threaded portion that threads with (e.g., screws into) the component 78 or protrudes through the component 78 and is mated with a threaded retainer (e.g., a nut).

Figure 4:
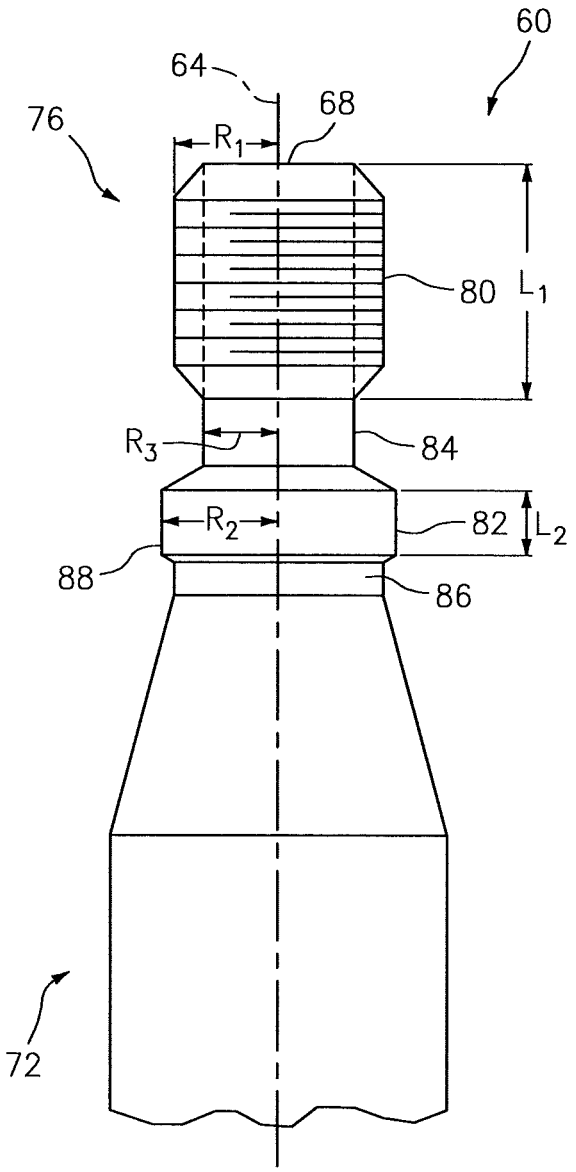
FIG. 4 is a side illustration of a portion of a tie-rod.

The outer mount 76 extends along the tie-rod axis 64 from the shaft 72 to the outer end 68. The outer mount 76 is configured to mate with the threaded retainer 62 and thereby structurally tie the shaft 72 and, thus, the tie rod 60 to the inner case 24 and, more particularly, the turbine intermediate case 44. Referring to FIG. 4, the outer mount 76 includes a tie-rod threaded portion 80 and a tie-rod unthreaded portion 82. The outer mount 76 may also include a tie-rod intermediate portion 84.

The threaded portion 80 of the tie rod 60 is located axially between the outer end 68 and the unthreaded portion 82. The threaded portion 80 of FIG. 4, for example, is located at (e.g., on, adjacent or proximate) the outer end 68. The threaded portion 80 extends axially from the outer end 68 towards the unthreaded portion 82 and to the intermediate portion 84. The threaded portion 80 has an outer radius $R_1$ and an axial length $L_1$.

The unthreaded portion 82 of the tie rod 60 extends axially towards the threaded portion 80 and to the intermediate portion 84. The unthreaded portion 82 may be configured as a radial outward projection. The unthreaded portion 82 of FIG. 4, for example, extends radially outward from a base portion 86 of the outer mount 76 to a radial outer surface 88. This surface 88 may be configured as a substantially smooth, flat and/or uninterrupted cylindrical surface. The surface 88 may have a substantially constant outer radius $R_2$ and an axial length $L_2$. The outer radius $R_2$ may be greater than the outer radius $R_1$ of the threaded portion 80. In alternative embodiments, however, the outer radius $R_2$ of the surface 88 and, thus, the unthreaded portion 82 may be substantially equal to the outer radius $R_1$ of the threaded portion 80.

The intermediate portion 84 of the tie rod 60 is arranged and/or extends axially between the threaded portion 80 and the unthreaded portion 82. The intermediate portion 84 has an outer radius $R_3$. This outer radius $R_3$ may be less than the outer radius $R_1$ and/or the outer radius $R_2$. In alternative embodiments, however, the outer radius $R_3$ of the intermediate portion 84 may be substantially equal to the outer radius $R_1$ of the threaded portion 80 and/or the outer radius $R_2$ of the unthreaded portion 82. In still alternative embodiments, the outer radius $R_3$ of the intermediate portion 84 may vary such that, for example, the intermediate portion 84 radially tapers from the unthreaded portion 82 to the threaded portion 80.

Figure 5:
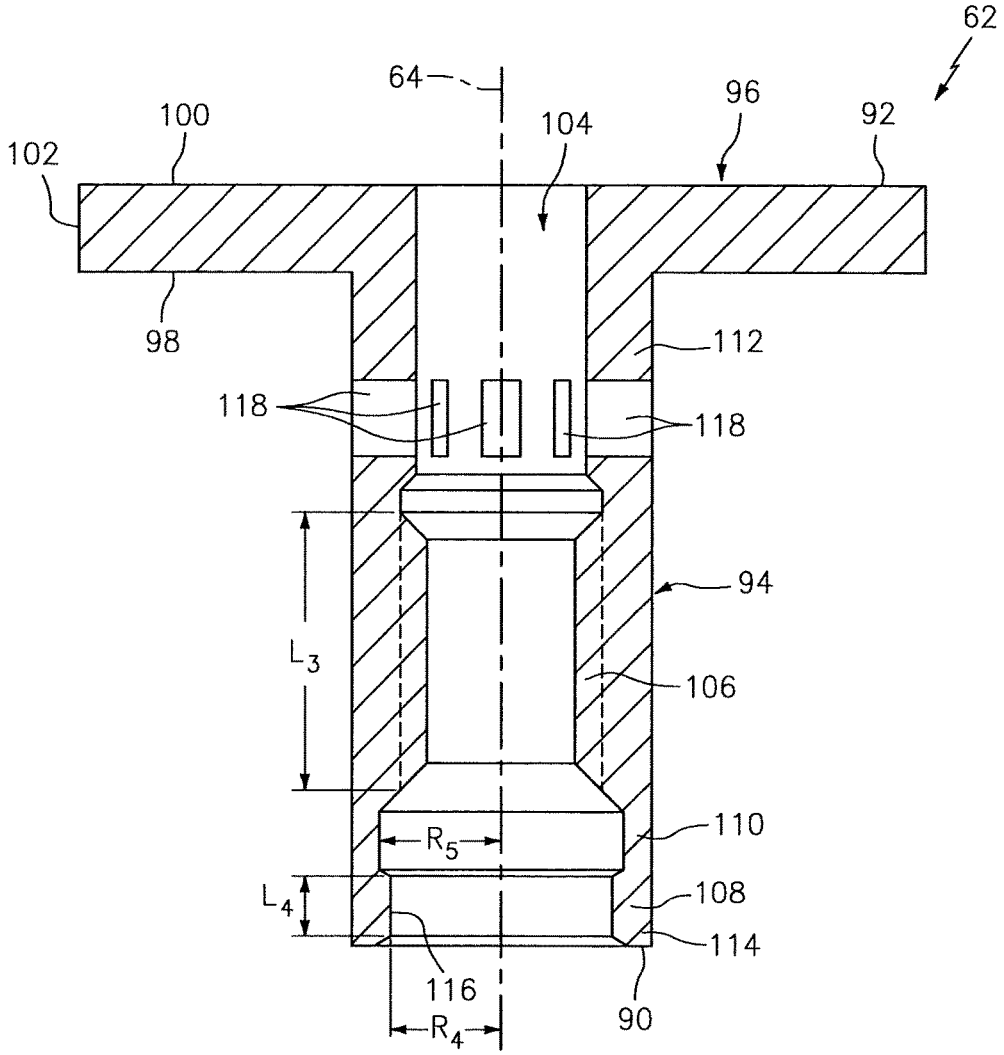
FIG. 5 is a side sectional illustration of a portion of a threaded retainer.

Referring to FIG. 5, the threaded retainer 62 extends along a threaded retainer axis between an inner end 90 and an outer end 92. The threaded retainer axis is substantially coaxial with the tie-rod axis 64 when the threaded retainer 62 is mated with the tie rod 60 and therefore is also identified by "64" for ease of description and illustration.

The threaded retainer 62 includes a (e.g., tubular) base 94 and a flange 96. The flange 96 is located at the outer end 92. The flange 96 extends axially between opposing flange surfaces 98 and 100. The flange 96 extends radially out from the base 94 to a distal flange end 102. The flange 96 may extend circumferentially around the base 94 thereby providing the flange 96 with an annular geometry.

Referring to FIG. 2, the flange 96 is configured to abut against a land or boss on the turbine intermediate case 44; e.g., the surface engages (e.g., contacts) the land. The flange 96 also includes one or more fastener apertures (not shown). One or more of these apertures each receives a respective fastener (e.g., a bolt), which secures the threaded retainer 62 to the turbine intermediate case 44. The threaded retainer 62, however, is not limited to any particular flange attachment method or configuration. Furthermore, in alternative embodiments, the flange 96 may simply abut against the inner case 24 without any additional attachment.

The base 94 is configured to project downwards from the flange 96 and through (or into) an aperture in the turbine intermediate case 44. The base 94 is further configured to mate with the outer mount 76 of the tie rod 60 and thereby secure the tie rod 60 to the inner case 24. The base 94 of FIG. 5, for example, extends axially from the outer end 92 and away from the flange 96 to the inner end 90.

The base 94 includes an inner bore 104. This inner bore 104 extends axially through (or partially into) the base 94 and, thus, the threaded retainer 62 from the inner end 90. The inner bore 104 is formed by a plurality of discrete portions of the threaded retainer 62 which are arranged along the threaded retainer axis 64. These portions include a retainer threaded portion 106 and a retainer unthreaded portion 108. The portions may also include a retainer intermediate portion 110 and/or a ventilation portion 112.

Figure 3:
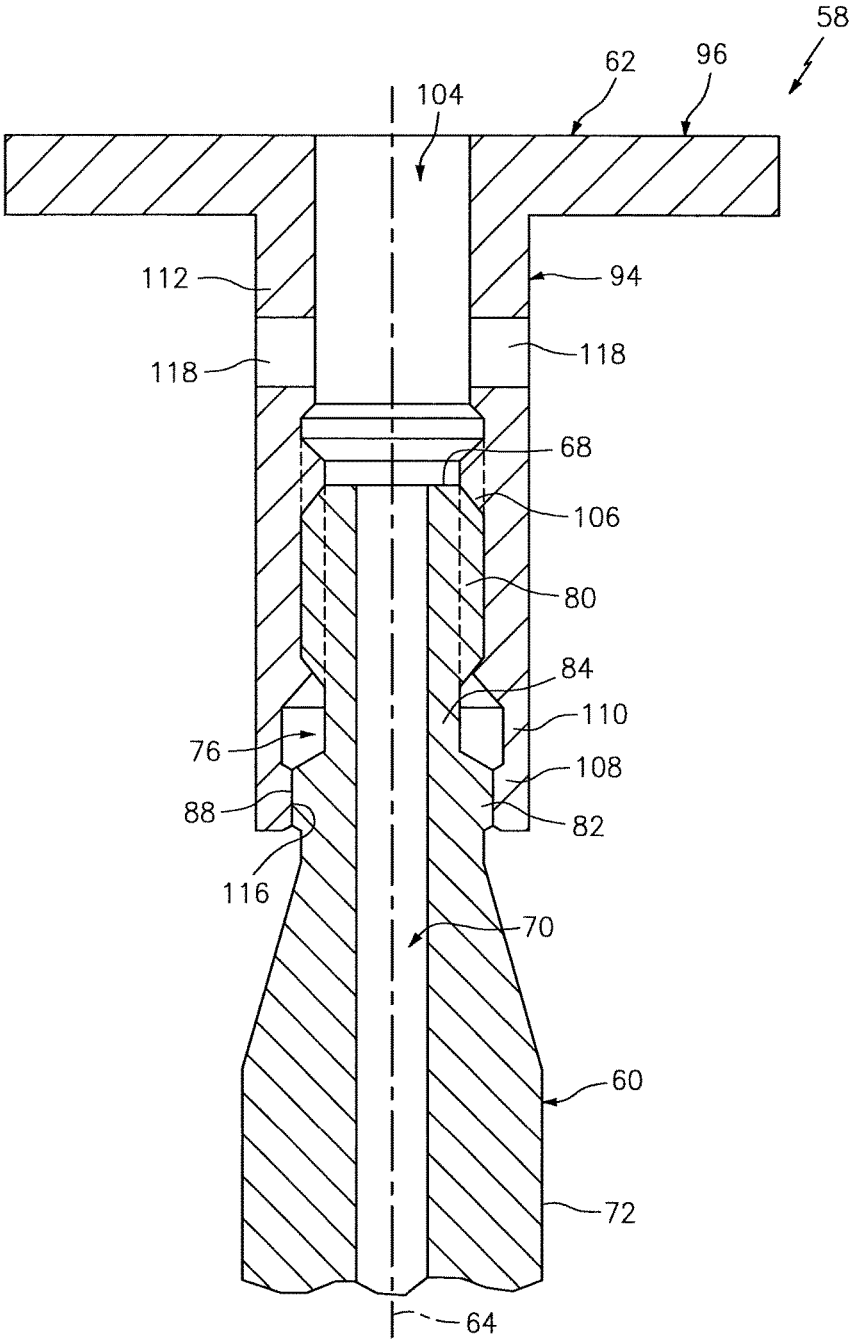
FIG. 3 is a side sectional illustration of a portion of a tie-rod assembly.

The threaded portion 106 of the threaded retainer 62 is configured to mate with the threaded portion 80 of the tie rod 60 (see FIG. 3); e.g., the threaded portion 80 is threaded into the threaded portion 106 of the threaded retainer 62. The retainer threaded portion 106 is located axially between the outer end 92 and the unthreaded portion 108. The threaded portion 106 extends axially towards the unthreaded portion 108 and to the intermediate portion 110. The threaded portion 106 has an axial length $L_3$, which may be greater than the axial length $L_1$ (see FIG. 4) of the tie-rod threaded portion 80 as shown in FIG. 3. Alternatively, the axial length $L_3$ may be substantially equal to or less than the axial length $L_1$ of the tie-rod threaded portion 80.

The unthreaded portion 108 of the threaded retainer 62 is configured to mate with and radially engage the unthreaded portion 82 of the tie rod 60 (see FIG. 3). The retainer unthreaded portion 108 is located at the inner end 90 of the threaded retainer 62. The unthreaded portion 108 extends axially from the inner end 90 and towards the threaded portion 106 and to the intermediate portion 110. The unthreaded portion 108 may be configured as a radial inward projection. The unthreaded portion 108 of FIG. 5, for example, extends radially inward from a base portion 114 of the base 94 to a radial inner surface 116. This surface 116 may be configured as a substantially smooth, flat and/or uninterrupted cylindrical surface. The surface 116 may have a substantially constant inner radius $R_4$ and an axial length $L_4$. The surface 116 is configured to radially engage and mate with the surface 88 (see FIG. 3).

The inner radius $R_4$ may be substantially equal to the outer radius $R_2$ (see FIG. 4) of the tie-rod unthreaded portion 82 and greater than the $R_1$ of the tie-rod threaded portion 80. In alternatively embodiments, however, the inner radius $R_4$ may be substantially equal to the outer radius $R_1$ of the tie-rod threaded portion 80.

The axial length $L_4$ may be substantially equal to the axial length $L_2$ (see FIG. 4) of the tie-rod unthreaded portion 82. In alternatively embodiments, however, the axial length $L_4$ may be greater or less than the axial length $L_2$ of the tie-rod unthreaded portion 82.

The intermediate portion 110 of the threaded retainer 62 is arranged and/or extends axially between the threaded portion 106 and the unthreaded portion 108. The intermediate portion 110 has an inner radius $R_5$. This inner radius $R_5$ may be greater than the inner radius $R_4$, the outer radius $R_2$ and/or the outer radius $R_3$. In alternative embodiments, however, the inner radius $R_5$ of the intermediate portion 110 may be substantially equal to the inner radius $R_4$ of the unthreaded portion 108. In still alternative embodiments, the inner radius $R_5$ of the intermediate portion 110 may vary such that, for example, the intermediate portion 110 radially tapers from the unthreaded portion 108 to the threaded portion 106. It is worth noting, with the foregoing configuration, the intermediate portions 84 and 110 (see FIG. 3) are separated by a gap and therefore radially and axially disengaged from one another.

The ventilation portion 112 of the threaded retainer 62 may be located and/or extend axially between the threaded portion 106 and the outer end 92. The ventilation portion 112 may include one or more vent apertures 118 arranged circumferentially about the threaded retainer axis 64. Each of the vent apertures 118 extends radially through the base 94 thereby fluidly coupling the inner bore 104 with a plenum 120 radially outside of the base 94 and the threaded retainer 62 as shown in FIG. 2.

During operation, referring to FIG. 3, axial and radial loads may be transferred between the tie rod 60 and the threaded retainer 62. Substantially all of the axial loads (e.g., loads along the axis 64) may be transferred through the mated threaded portions 80 and 106. Substantially all of the radial loads (e.g., loads perpendicular to the axis 64) may be transferred through the mated unthreaded portions 82 and 108 as well as the mated threaded portions 80 and 106. The mated unthreaded portions 82 and 108 may accommodate the tie rod 60 being subjected to a moment and reduce or eliminate moment induced internal stresses on the threaded portions 80 and 106.

In some embodiments, at least a portion of the tie-rod 60 and/or at least a portion of the threaded retainer 62 may be coated with lubricant; e.g., dry film lubricant to provide a wear buffer therebetween. The surface 88 and/or the surface 116, for example, may each be coated with such lubricant.

In some embodiments, the tie rod 60 may be replaced with a similarly configured fastener thereby providing a fastener assembly. A bolt or any other type of fastener, for example, may be configured with a mount and a shaft similar to the outer mount 76 and the shaft 72 described above. In a similar fashion, the threaded retainer 62 may also or alternatively have various configurations other than that described above and illustrated in the drawings.

Figure 6:
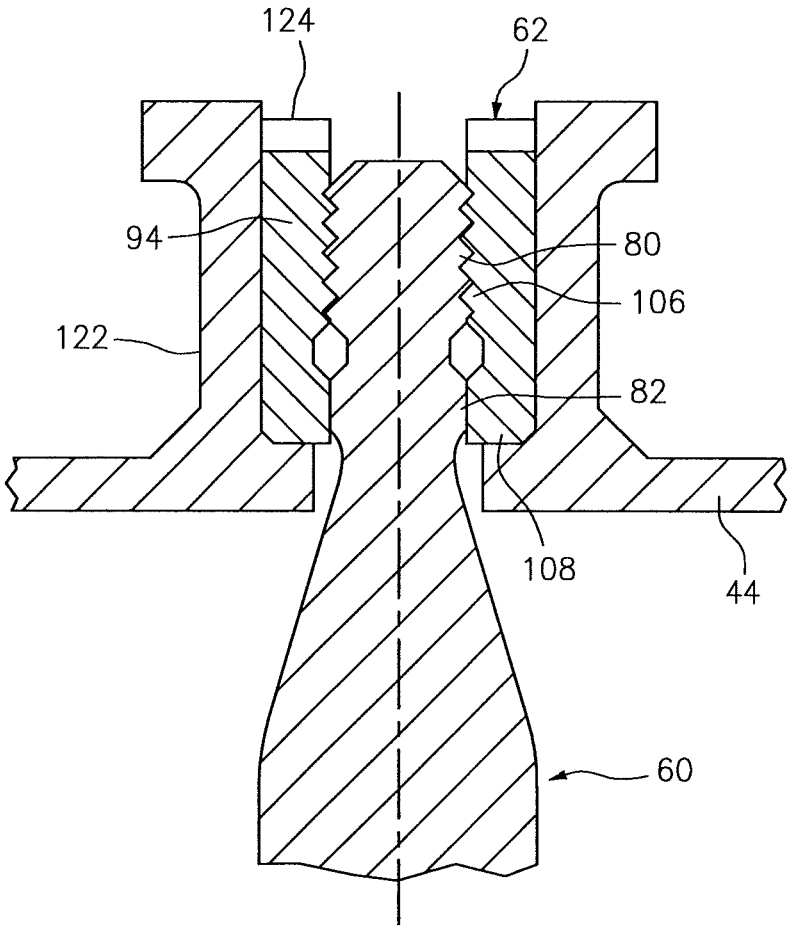
FIG. 6 is a side sectional illustration of an alternate embodiment assembly for the turbine engine.

In some embodiments, referring to FIG. 6, the threaded retainer 62 may be configured without a flange; e.g., the flange 96. An outer portion of the base 94, for example, may engage the boss 122 in the turbine intermediate case 44. An end 124 of the base 94 may be castellated to enable mating with a tool (not shown) for retainer 62 installation and removal.

The terms "inner" and "outer" are used to orientate the components of the tie-rod assembly 58 described above relative to the turbine engine 10 and its centerline 12. One or more of these components, however, may be utilized in other orientations than those described above. The present invention therefore is not limited to any particular spatial orientations.

The tie-rod assembly 58 may be included in various turbine engines other than the one described above. The tie-rod assembly 58, for example, may be included in a geared turbine engine where a gear train connects one or more shafts to one or more rotors in a fan section, a compressor section and/or any other engine section. Alternatively, the tie-rod assembly 58 may be included in a turbine engine configured without a gear train. The tie-rod assembly 58 may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines. Furthermore, the tie-rod assembly 58 may alternatively be configured for use in non-turbine engine applications; e.g., any application where axial and radial loads are transferred between a threaded retainer and a fastener such as, for example, a tie-rod.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. An assembly for a turbine engine, comprising:

a tie-rod extending along a tie-rod axis, the tie-rod including a tie-rod threaded portion and a tie-rod unthreaded portion; and a threaded retainer including a retainer threaded portion and a retainer unthreaded portion, and the retainer threaded portion mated with the tie-rod threaded portion;

wherein the tie-rod unthreaded portion comprises a first cylindrical surface and the retainer unthreaded portion comprises a second cylindrical surface;

wherein the second cylindrical surface is radially engaged with, relative to the tie-rod axis, the first cylindrical surface;

wherein the tie-rod extends axially to an end, and the tie-rod threaded portion is axially between the end and the tie-rod unthreaded portion; and wherein the tie-rod threaded portion is located at the end.

2. The assembly of claim 1, wherein the tie-rod extends axially through the retainer unthreaded portion and into the retainer threaded portion.

3. The assembly of claim 1, wherein the tie-rod threaded portion and the tie-rod unthreaded portion are axially separated by another portion of the tie-rod that is radially disengaged from the threaded retainer.

4. The assembly of claim 1, wherein the tie-rod unthreaded portion comprises a radial outward projection.

5. The assembly of claim 1, wherein the retainer unthreaded portion comprises a radial inward projection.

6. The assembly of claim 1, wherein the retainer threaded portion and the retainer unthreaded portion are axially separated by another portion of the threaded retainer that is disengaged from the tie-rod.

7. The assembly of claim 1, wherein the threaded retainer includes a tubular base and an annular flange extending radially out from the tubular base.

8. The assembly of claim 1, further comprising a turbine engine case, wherein the threaded retainer attaches the tie-rod to the turbine engine case.

9. The assembly of claim 8, wherein the turbine engine case comprises a turbine intermediate case.

10. The assembly of claim 1, wherein at least one of the retainer unthreaded portion or the tie-rod unthreaded portion is coated with lubricant.

11. The assembly of claim 1, wherein the retainer unthreaded portion is configured to slide axially against the tie-rod unthreaded portion relative to the tie-rod axis.

12. An assembly for a turbine engine, comprising:

a tie-rod extending along a tie-rod axis, the tie-rod including a tie-rod threaded portion and a tie-rod unthreaded portion; and a threaded retainer including a retainer threaded portion and a retainer unthreaded portion, and the retainer threaded portion mated with the tie-rod threaded portion;

wherein the tie-rod unthreaded portion comprises a first cylindrical surface and the retainer unthreaded portion comprises a second cylindrical surface;

wherein the second cylindrical surface is radially engaged with, relative to the tie-rod axis, the first cylindrical surface; and wherein the tie-rod extends axially to an end disposed within the threaded retainer, and the tie-rod threaded portion is axially between the end and the tie-rod unthreaded portion.

13. The assembly of claim 12, wherein the tie-rod threaded portion is located at the end.

14. An assembly for a turbine engine, comprising:

a tie-rod extending along a tie-rod axis, the tie-rod including a tie-rod threaded portion and a tie-rod unthreaded portion; and a threaded retainer including a retainer threaded portion and a retainer unthreaded portion, and the retainer threaded portion mated with the tie-rod threaded portion;

wherein the tie-rod unthreaded portion comprises a first cylindrical surface and the retainer unthreaded portion comprises a second cylindrical surface;

wherein the second cylindrical surface is radially engaged with, relative to the tie-rod axis, the first cylindrical surface;

wherein the threaded retainer includes a tubular base and an annular flange extending radially out from the tubular base; and wherein the retainer threaded portion is located axially between the annular flange and the retainer unthreaded portion.

* * * * *